US007991500B2

(12) United States Patent
Roos

(10) Patent No.: US 7,991,500 B2
(45) Date of Patent: Aug. 2, 2011

(54) SEWING ORDER FOR BASIC ELEMENTS IN EMBROIDERY

(75) Inventor: Lars Roos, Ulricehamn (SE)

(73) Assignee: VSM Group AB, Huskvarna (SE)

( * ) Notice: Subject to any disclaimer, the term of this patent is extended or adjusted under 35 U.S.C. 154(b) by 372 days.

(21) Appl. No.: 12/195,513

(22) Filed: Aug. 21, 2008

(65) Prior Publication Data

US 2009/0055015 A1 Feb. 26, 2009

(30) Foreign Application Priority Data

Aug. 21, 2007 (SE) ..... 0701886

(51) Int. Cl.
*D05C 5/02* (2006.01)

(52) U.S. Cl. ..... 700/138; 112/102.5; 112/475.19

(58) Field of Classification Search ..... 700/136–138; 112/102.5, 103, 470.01, 470.04, 470.06, 112/475.18, 475.19
See application file for complete search history.

(56) References Cited

U.S. PATENT DOCUMENTS 4,991,524 A * 2/1991 Ozaki ..... 112/102.5
5,191,536 A * 3/1993 Komuro et al. ..... 700/138
5,560,306 A * 10/1996 Kyuno et al. ..... 112/102.5
5,701,830 A 12/1997 Muto
5,765,496 A * 6/1998 Futamura ..... 112/475.19
5,784,987 A * 7/1998 Mizuno ..... 112/102.5
5,896,822 A 4/1999 Futamura
5,899,154 A * 5/1999 Mizuno ..... 112/102.5
6,012,402 A * 1/2000 Sekine ..... 112/102.5
6,237,516 B1 * 5/2001 Wakayama ..... 112/102.5
6,600,966 B1 * 7/2003 Bailie ..... 700/138

* cited by examiner

*Primary Examiner* — Gary L. Welch
*Assistant Examiner* — Nathan E Durham
(74) *Attorney, Agent, or Firm* — Venable LLP; Eric J. Franklin

(57) ABSTRACT

A sewing order is determined in embroidering at least one embroidery element on a sewing material in a sewing machine, which has access to a memory for stitch data for the embroidery element and a processor for reading the stitch data and for maneuvering the sewing machine to execute stitches according to the stitch data. An embroidery element is composed of basic elements, through a formation of clusters of basic elements having the same characteristics. A level for each cluster is determined. The clusters are sorted with regards to their respective characteristics and sorting of the clusters into a sewing order based on characteristics and levels of the clusters.

5 Claims, 7 Drawing Sheets

SEWING ORDER FOR BASIC ELEMENTS IN EMBROIDERY

CROSS-REFERENCE TO RELATED APPLICATIONS

This application claims priority to Swedish patent application 07018864 filed 21 Aug. 2007.

1. Technical Field

The present invention relates to a method for establishing a sewing order in embroidering at least one embroidery element on a sewing material in a sewing machine according to an algorithm, the invention further encompassing a software product programmed with said algorithm.

2. Prior Art

Executing embroideries by means of a sewing machine, in which the embroidery can be stored in its entirety in a memory that contains stitch data for the embroidery, is already known. An operator has a sewing material, for example, on which the embroidery is to be executed, stretched out on an embroidery frame, which is arranged on the sewing machine in such a way that a control program for the sewing machine mechanically moves the embroidery frame according to the control program and stitch data for executing the embroidery on the sewing material. The operator is free to create or select from a database one or more embroidery elements, which are stored in the memory, in order to build up said embroidery. The sewing material is usually a fabric, which term will henceforward be used as an example to denote all types of sewing material.

An embroidery element forming part of said embroidery is made up of at least one and usually a plurality of basic elements, which comprise at least one stitch of any stitch type executed with a thread of a certain colour and/or with a thread of a certain quality, such as a silk thread, for example. The thread type in different basic elements is usually of the same sort, but various thread types of the same colour could occur in different basic elements.

In planning the embroidery the operator lays out the various embroidery elements over an sub-area of the fabric. This layout of embroidery elements can be performed on a screen, which displays an image of the available embroidery sub-area of the fabric, for example the sub-area of the fabric contained within said embroidery frame.

When embroidering or sewing on a fabric in a sewing machine the embroidery elements are conventionally sewn in the order in which they are laid out on the fabric and hence stored in the memory. The basic elements in each embroidery element are also conventionally sewn in a predefined order, for example in the order in which they are listed in a program that contains data for the embroidery element. A further complication arises when the fabric is stretched on an embroidery frame which is of such a size that the needle for executing the stitches only has access to half of the fabric surface stretched out inside the embroidery frame. With such embroidery frames, which are common nowadays, the embroidery frame must be turned and remounted in an embroidery unit before basic elements in the embroidery element can be embroidered with stitches on the other half of the fabric. The conventional technique for embroidering usually relies on the fact that embroidery elements are embroidered, as stated, in the order in which they are set out. Such a sequence may then necessitate multiple turns of the embroidery frame, which creates difficulties. Some machines can be programmed to ask the operator whether all embroidery elements on one and the same half side of the fabric in the embroidery frame are to be completed before it becomes necessary to turn the embroidery frame. This procedure is not ideal either, since no account will be taken here of the fact that certain parts of embroidery elements can overlie parts of other embroidery elements, something which is undesirable, since the result of the process may not be aesthetically pleasing.

DESCRIPTION OF THE INVENTION

An object of the present invention is to demonstrate a method and an arrangement for determining a sewing order for embroidering on a fabric by means of a sewing machine, which reduces the number of adjustments and operations in performing the embroidery.

In embroidering, an embroidery unit is generally used, which is a part of a sewing machine that is used specifically for embroidery, in which the aforementioned embroidery frame constitutes a part of the embroidery unit for moving the fabric. The sewing machine guides the embroidery frame in two directions, for example in an x direction and in a y direction, via stepper motors, one for each direction. An embroidering machine of this type controls the movements of the embroidery frame for embroidering an embroidery element according to data for stitch coordinates stored in a memory accessible to the sewing machine.

The present document describes a method that can be used when embroidering on sewing machines. One aspect of the method describes an algorithm, which is used for sorting basic elements forming part of the embroidery elements that make up an embroidery, which is to be executed on the sewing machine, in an order in which the basic elements are to be sewn so as to minimize, as far as possible, the number of times the sewing machine has to be reloaded in respect of colour type and thread type when sewing on different sub-areas of the fabric, where said sub-areas are accessible only by adjusting the sewing machine, for example by turning an embroidery frame, in order thereby to minimize the number of colour and/or thread changes whilst maintaining the layout of the embroidery. The order of priority for the stitches in basic elements, which are placed one on top of the other, must therefore be retained.

The algorithm described according to the invention does not guarantee that the optimum placing of stitches will be achieved. The algorithm has been developed through the use of a heuristic procedure, the algorithm having been optimized in order to solve a number of typical examples, and uses examples as described in the present document.

The advantages of the method according to the invention are, as already stated, that the number of thread changes in performing the embroidery are minimized, whilst the number of turns of the embroidery frame and the number of adjustments to the sewing machine for access to sewing sub-areas are considerably reduced compared to the prior art.

The invention utilizes an algorithm, according to which a processor available on the sewing machine executes the stitches, the sewing machine processor using a program which is coded for controlling the embroidery according to said algorithm.

LIST OF DRAWINGS

FIG. 1 shows a basic sketch drawing of a sewing machine with an embroidery frame mounted thereon.

FIG. 2 schematically shows an example of a cluster analysis based on a colour sorting of seven basic elements.

DESCRIPTION OF EMBODIMENTS

A number of embodiments of the invention are described below with reference to the drawings attached.

Figure 1:
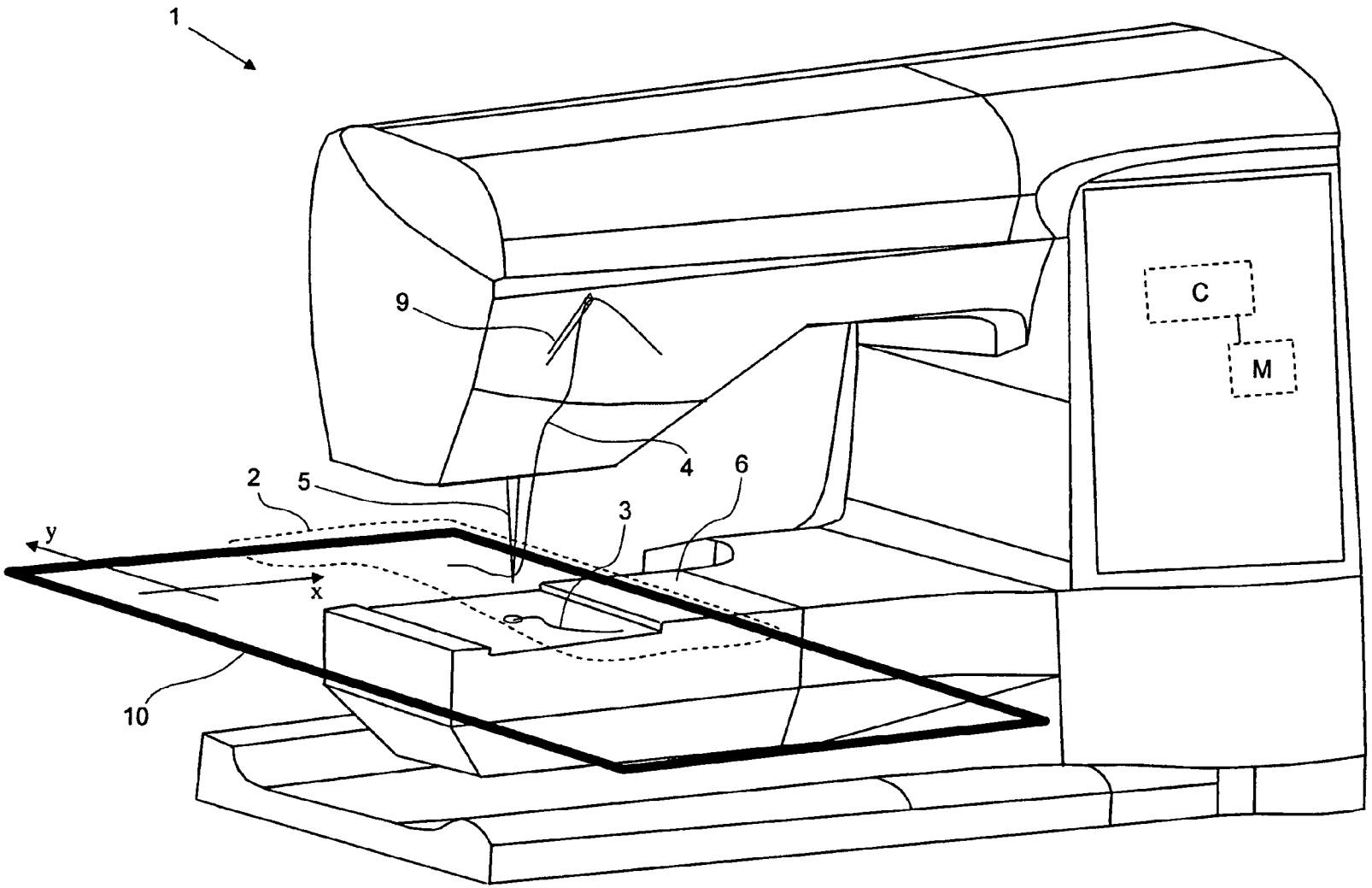

As an example of the function, FIG. 1 shows an embroidering machine 1 in which, according to the example, a sewing machine is used for executing stitches in a desired embroidery, in which a fabric 2 is advanced between a lower thread 3 and an upper thread 5 in a known manner for executing a seam made up of the desired stitches by means of a needle 5, which is periodically carried through the fabric 2. In the example the fabric 2 is carried over a worktable 6, which also contains a bobbin, designed to accommodate the lower thread 3 and encapsulated in a shuttle in a known manner (not shown) in an underarm 1*a* of the sewing machine. The upper thread 4 is led via a take-up lever 9, which through a cyclical up and down movement produces a loop of the upper thread 4 beneath the fabric 2 when the needle 5, through the eye of which the upper thread 4 runs, has brought the upper thread through the fabric 2 and the take-up lever 9 returns upwards from its lowest position. A shuttle tip (not shown) of the shuttle in a known manner catches said loop when the shuttle rotates cyclically in coordination with the needle. For executing a stitch, in this a lockstitch, the needle 5 is brought in a reciprocating movement in a direction substantially perpendicular to the fabric 2, so that the needle 5 carries the upper thread 4 down through the fabric 2, following which the shuttle carries the upper thread 4 around a bobbin that houses the lower thread 3, producing a knot in the fabric 2 when the needle 5 has been brought up through the fabric and the take-up lever 9 tightens the knot in the stitch.

Accompanying the machine in the prior art is a control program, which is stored in a processor C, for example. The sewing machine also has an accessible memory M, which is preferably located in the sewing machine but which may also be situated externally and accessible from the processor C. When the sewing machine is used for embroidering embroidery elements, the memory M affords the facility for storing sewing patterns for embroideries in the form of stitch data for one or a plurality of such embroidery elements. The sewing pattern comprises at least one and usually a plurality of basic elements, which may have characteristics common to more than one embroidery element. Such basic elements may therefore have a colour common to multiple embroidery elements or a thread type common to multiple embroidery elements.

FIG. 1 also shows an embroidery frame 10 designed for the sewing machine, in which a piece of fabric 2 is stretched on the embroidery frame. The fabric piece 2 is only shown symbolically in the drawing as covering only a part of the embroidery frame and is shown with dashed outline in order to make the arrangements clearer. The embroidery frame 10 is fixed to a first feed arrangement controlled by a first stepper motor (not shown), which maneuvers the embroidery frame in an x direction, this x direction according to the example largely coinciding with the longitudinal axis of the sewing machine. The embroidery frame 20 is correspondingly fixed to a second feed arrangement controlled by a second stepper motor (not shown) which maneuvers the embroidery frame in a y direction, this y direction according to the example being perpendicular to the x direction and coinciding with the sewing direction, that is to say the direction in which the needle executes a seam on the fabric 2, when no lateral deviation of the seam is called for. By controlling the stepper motors with signals from the processor C, the embroidery frame 10, with fabric pieces stretched thereon, is maneuvered for a movement in any direction in the x-y plane. The movements are generated by an embroidery unit, which is not shown, since this constitutes prior art and does not form a part of the present invention. The embroidery unit comprises said stepper motors and feed arrangements for the embroidery frame 10, which is suitably connected to the embroidery unit and its feed system.

It has been found according to the invention that the sorting of basic elements in sewing order (the term sewing order is here used to denote the order in which the basic elements are sewn in sequence when embroidering) for a sub-sub-area (for example, one or the other half of the embroidery frame 10, or the equivalent. An embroidery sub-area which is accessible by the sewing machine without adjusting the latter will henceforward be exemplified by the term side in an embroidery frame but the term 'side' is to be regarded only as one example of such an embroidery sub-area) for each colour and thread type can be undertaken in the same way, that is to say one and the same algorithm can be used in all cases. The algorithm described below is an abstract algorithm, which sorts different characteristics of the basic elements, the precise characteristics, that is to say the colour of a colour basic element or the position of a basic element on either side of the embroidery frame being of lesser interest, provided that it is possible to compare the different characteristics. Comparison therefore focuses on whether two basic elements have the same colour (or thread type) or whether two basic elements occur on the same side of the embroidery frame 10. It must be noted here that a basic element may have different characteristics in terms of the colour of the thread, for example. Different characteristics might also possibly mean that the basic element has the characteristic that the thread type is silk, for example. In order to simplify the description and the algorithm, the characteristic "thread type" is classified under the characteristic "colour". A certain thread type in a certain basic element may therefore be treated by identifying the thread type in the basic element and denoting it by the colour characteristic, which consequently means that the algorithm implicitly includes the thread type under the term colour, if different thread types occur in the embroidery, thereby increasing the number of colour characteristics and including all colours and thread types.

The algorithm is based on the following assumptions:

1. The original sewing order is the sewing order in which a user has added, that is to say set out, embroidery elements/basic elements of the embroidery and is a sewing order that is to be retained provided that the embroidery elements/the basic elements have the same characteristics.
2. Embroidery elements/basic elements which do not cover other embroidery elements/basic elements not yet embroidered may be sewn independently of one another.
3. The original sewing order must be maintained for embroidery elements/basic elements that are placed one on top of the other.

The entire sorting algorithm is divided into two different parts: a first part which performs an analysis of the embroidery and which builds up a structure, which is applicable to a second part, which contains the actual sorting algorithm for the sewing order. The first part, the analysis part, is further divided into three parts, a cluster analysis, a coverage analysis and a characteristics analysis. The algorithm according to one embodiment is described here:

1. Analysis
   a. Cluster Analysis
      Form clusters of embroidery elements/basic elements which have the same characteristics. Each cluster is treated as a single object in the following steps.
   b. Coverage Analysis
      Determine layer order, i.e. identify clusters which are situated on others likewise identified.
   c. Sort the various clusters according to their characteristics, making it possible to easily select clusters with the same characteristics
2. Sewing Order Perform the final sorting in order to determine the sewing order, that is to say in what order the basic elements are to be sewn out on the fabric.

The different parts of the algorithm are described in more detail below.

The Cluster Analysis

In the cluster analysis clusters of basic elements are formed which have the same characteristics, each cluster having the following characteristics:

All basic elements in a cluster have been added to the embroidery in a sequence. That is to say the index of the basic element is N . . . N+(k−1), where k is the number of basic elements in the cluster.

All basic elements in a cluster have the same characteristic.

Figure 2:
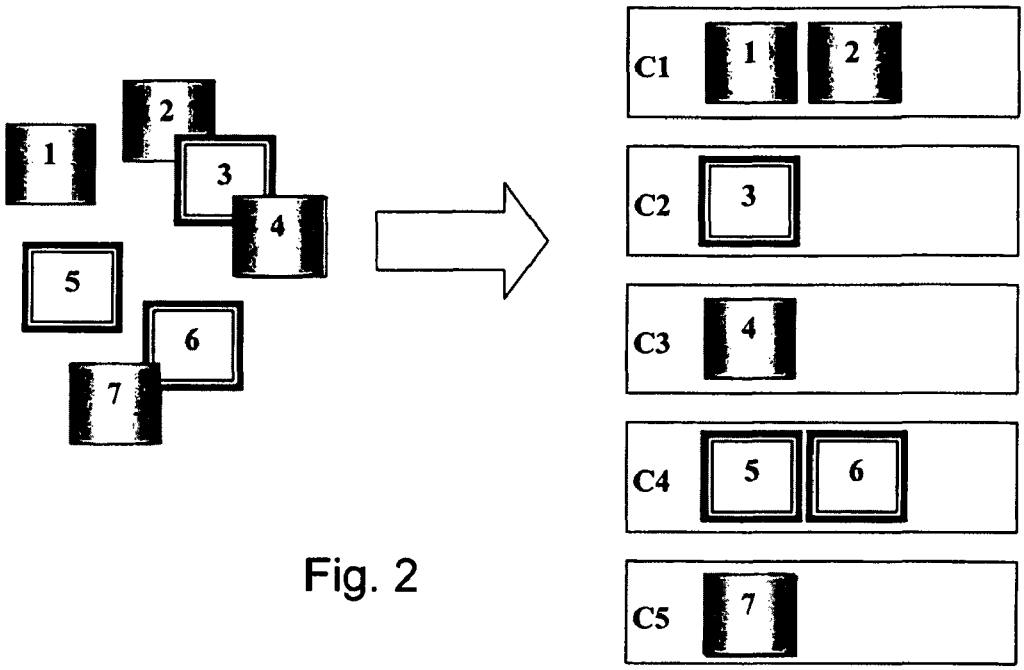

FIG. 2 shows an example of a cluster analysis based on a colour sorting of seven basic elements sorted into five different clusters, where the basic elements in each cluster, C1 to C5, are characterized by the same characteristics according to the assumptions of the algorithm above.

Coverage Analysis

The aim of the coverage analysis is to determine the levels of the basic elements (i.e. the order for layers of the basic elements one on top of another) and which clusters are placed on top of one another. A cluster is defined as lying on top of, that is to say covering another cluster, if at least a part of a basic element in a cluster is situated on top of at least one part of a basic element in another cluster.

The analysis is performed as follows:

For each cluster CN where 1≦N≦the number of clusters, proceed as follows:

1. Set the level for CN to 0.
2. For each previously checked cluster Ci, where 1≦i≦N−1, proceed as follows:
   if CN covers Ci, that is to say if an intersection exists between CN and C1, which means that the cluster CN therefore has to be sewn after the cluster C1:
   a. Add a two-way link between the two clusters to indicate which of the two clusters is situated on top of the other (CN on top of Ci),
   b. Set the level of CN to MAX (level CN, level Ci+1)

The result of the coverage analysis is a list of clusters, in which each cluster has the following inserted information on the basic elements it contains:

Reference to the basic elements contained.

Reference to all clusters in the level on top, i.e. to all clusters that are to be sewn after this cluster.

Reference to all clusters on any underlying level, i.e. to all clusters what are to be sewn before this cluster.

The cluster level 0 indicates the lowest level, i.e. that there is no cluster below this one.

Note: Sewing the clusters level by level starting from level 0 maintains the layout, since clusters situated on top of one another never have the same level according to the above algorithm.

Figure 3:
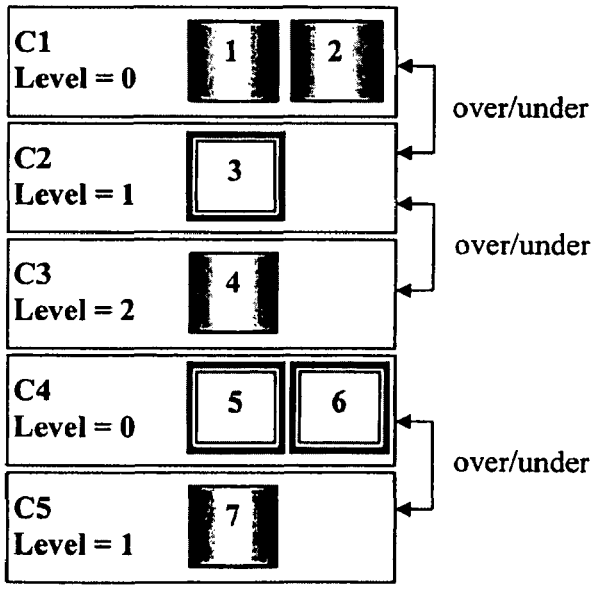
FIG. 3 shows the result of a coverage analysis performed for the five different clusters created and shown according to FIG. 3.

FIG. 3 shows the result of a coverage analysis performed for the five different clusters created and shown in FIG. 2.

Characteristics Analysis

The aim of the characteristics analysis is to form a structure which is suitable for the final step, i.e. generating the sewing order. The characteristics analysis creates a structure in which the different clusters are sorted characteristic by characteristic and level by level (layer by layer).

Table 1 below shows the result of a characteristics analysis undertaken for the results shown in FIG. 3.

TABLE 1

| Characteristic | Level | Cluster | Basic element | Cluster below | Cluster above |
|---|---|---|---|---|---|
| P1 = yellow | 0 | C1 | 1, 2 | — | C2 |
| | 1 | C5 | 7 | C4 | — |
| | 2 | C3 | 4 | C2 | — |
| P2 = green | 0 | C4 | 5, 6 | — | C5 |
| | 1 | C2 | 3 | C1 | C3 |

Sorting into Sewing Order

The algorithm finally comprises a sorting to determine the sewing order for the basic elements, using the structure that is built up during the analysis phase and proceeding as follows:

Run through all levels, where 0≦L≦the number of levels:

1. Run through all characteristics:
   If the characteristic has associated clusters on level L, but not on level L+1(1):
   Place these clusters into a list for sewing order and remove said clusters, and cross-references relating thereto from the analytical structure.
2. Run through all characteristics (again)
   If the characteristic has at least one associated cluster on level L:
   i. Place the clusters into the list for sewing order and remove the clusters, and cross-references relating thereto from the analytical structure.
   ii. Run through all referenced clusters to on the level above, i.e. by starting from level L+1(2):
      For all clusters that do not have any references to any clusters below: place the clusters into the list for sewing order and remove the clusters, and cross-references relating thereto from the analytical structure.

Note (1): The aim of this loop is to minimize the number of changes in characteristics by starting with characteristics that do not build up chains between different levels and which consequently retain these for later use, see Note (2) below.

Note (2) The aim of this loop is to minimize the number of changes in characteristics by keeping to a specific characteristic for as long as possible, i.e. by building up chains between different levels.

Table 2 below shows the result of the sorting of the sewing order performed on the analysis according to Table 1.

TABLE 2

| Sewing index | Cluster | Characteristic | Basic element |
|---|---|---|---|
| 1 | C1 | P1 = yellow | 1, 2 |
| 2 | C2 | P2 = green | 3 |
| 3 | C2 | P2 = green | 5, 6 |

TABLE 2-continued

| Sewing index | Cluster | Characteristic | Basic element |
|---|---|---|---|
| 4 | C5 | P1 = yellow | 7 |
| 5 | C3 | P1 = yellow | 4 |

The final sewing order is determined by sewing the different clusters, basic element by basic element, whilst maintaining their relative order. Thus, according to the example, the basic elements will be sewn in the following order: {1, 2, 3, 5, 6, 7, 4}.

Figure 4:
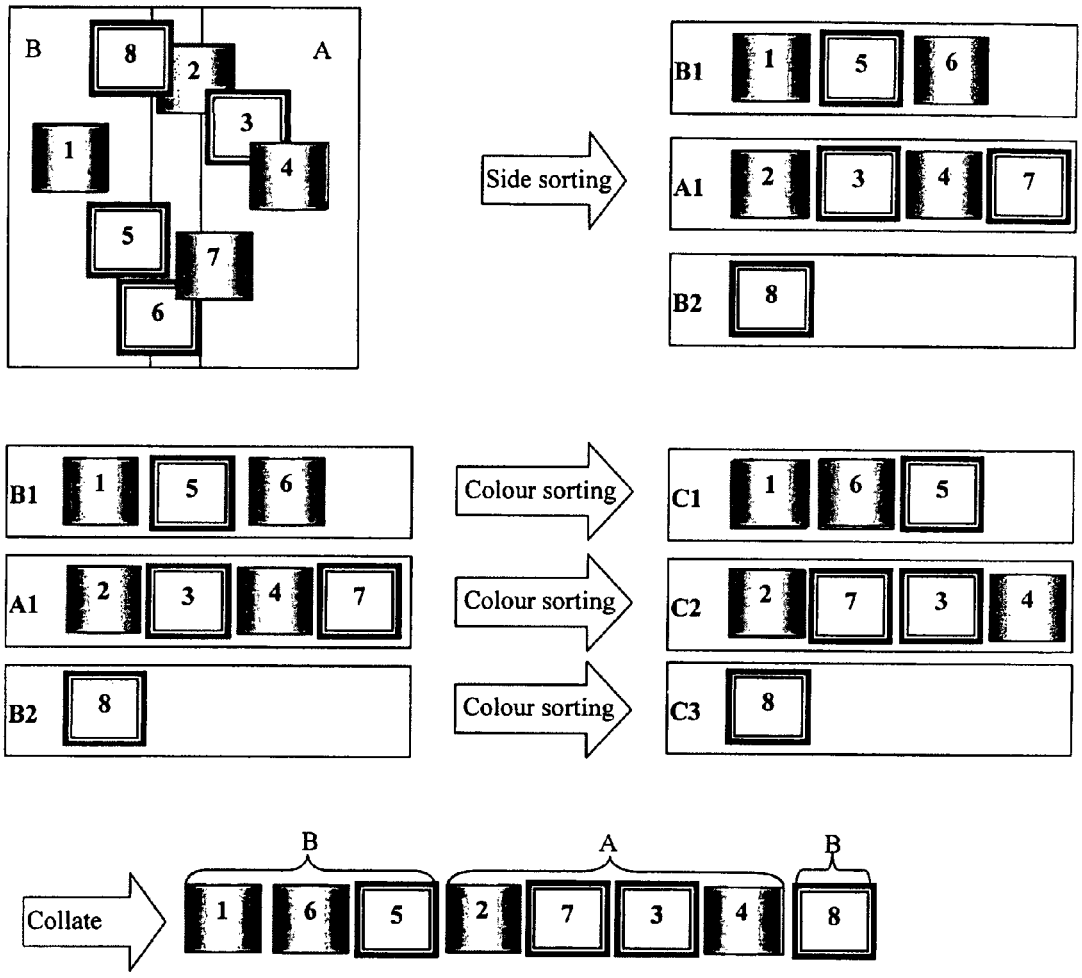
FIG. 4 shows a combined side and colour sorting according to the algorithm.

Combined side and colour sorting (see FIG. 4).

The combined side and colour sorting is performed according to the description below (the term side in this case means the side (for example, A or B in the figure) of an embroidery frame or the like on which the basic elements are situated in the overall embroidery).

1. Perform side sorting of the embroidery elements or basic elements in the embroidery designs.
2. Based on the result of the side sorting: build up clusters with basic elements, each cluster containing basic elements, which must be sewn on the same side of the embroidery (the upper part in FIG. 4).
3. Perform the colour sorting for each cluster of basic elements (middle part of FIG. 4).
4. Collate the results of all colour sortings into a single list in which all basic elements are arranged in one sewing order (bottom of FIG. 4).

Algorithm Tests

Side Sorting

A number of examples which further illustrate the outcome of the sewing order according to the algorithm are given below.

Figure 5:
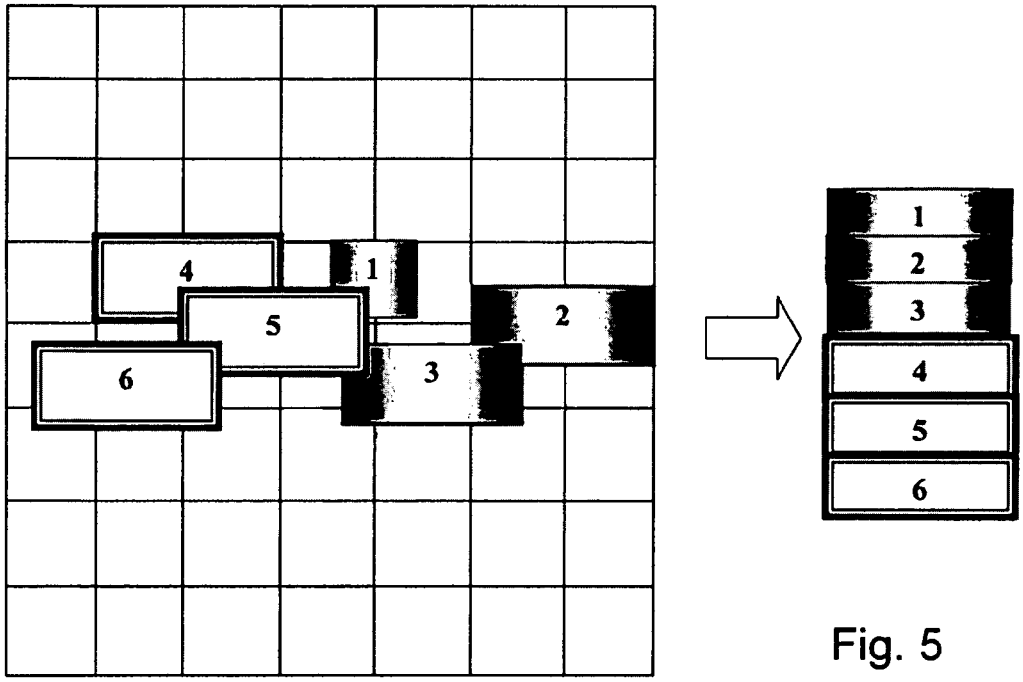
FIGS. 5 to 11 show a number of examples of the outcome of sorting basic elements forming part of various embroidery elements, using the algorithm according to the aspect of the invention.

FIG. 5 shows an embroidery with an embroidery element in each case comprising three basic elements, the embroidery elements each being situated on one half of an embroidery frame. The sewing order is shown on the right. It becomes necessary to turn the embroidery frame.

Figure 6:
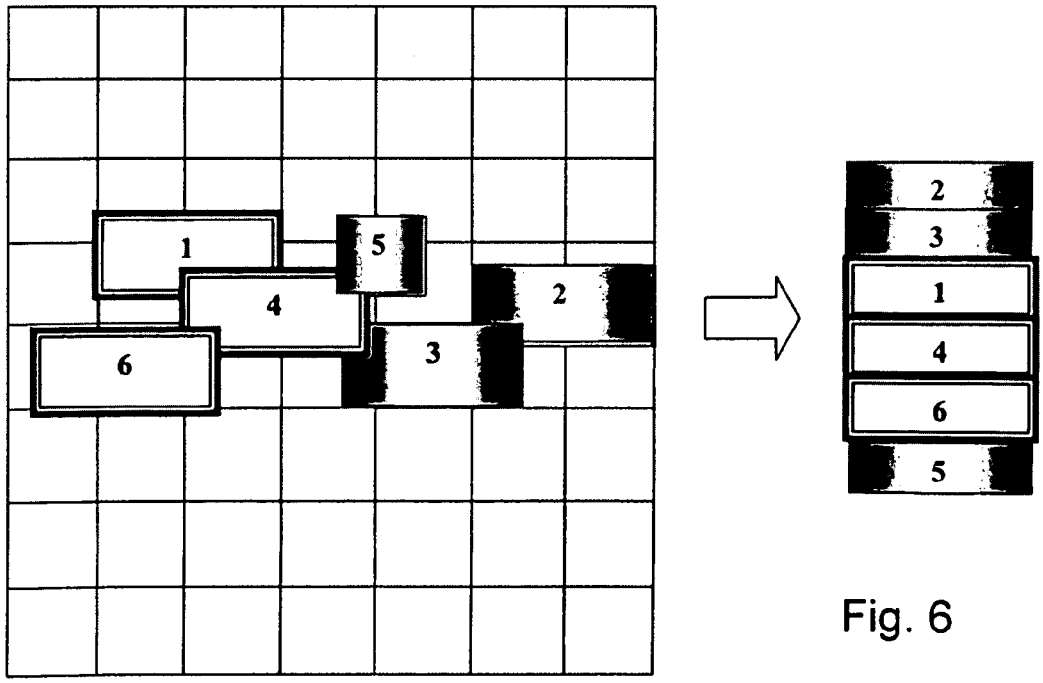

FIG. 6 shows an embroidery with basic elements distributed on halves of the embroidery frame in a way that leads to a sewing order of the basic elements as shown on the right of the figure and which gives rise to two turnings of the embroidery frame.

Colour Sorting

Figure 7:
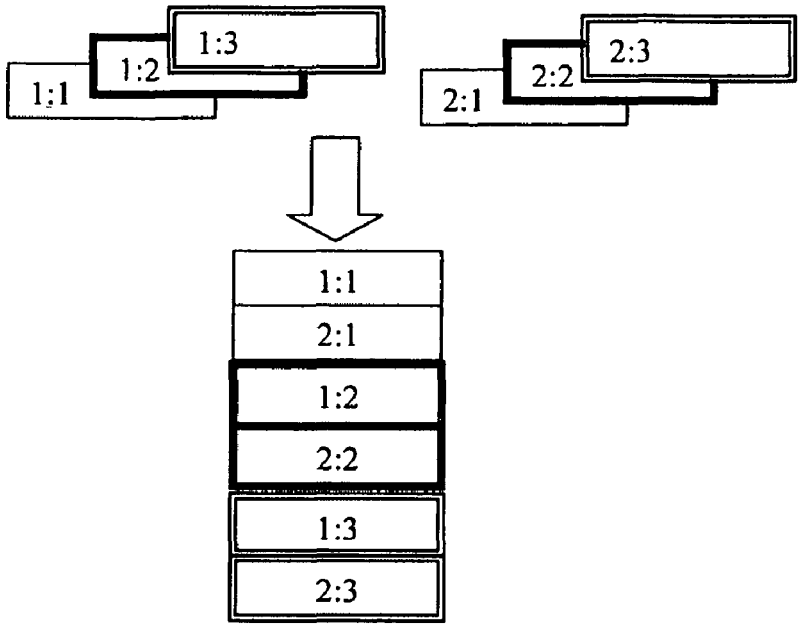

FIG. 7 shows two embroidery elements adjoining one another in an embroidery, the basic elements having different colours within each embroidery element. The outcome of the colour sorting is shown at the bottom of the figure.

Figure 8:
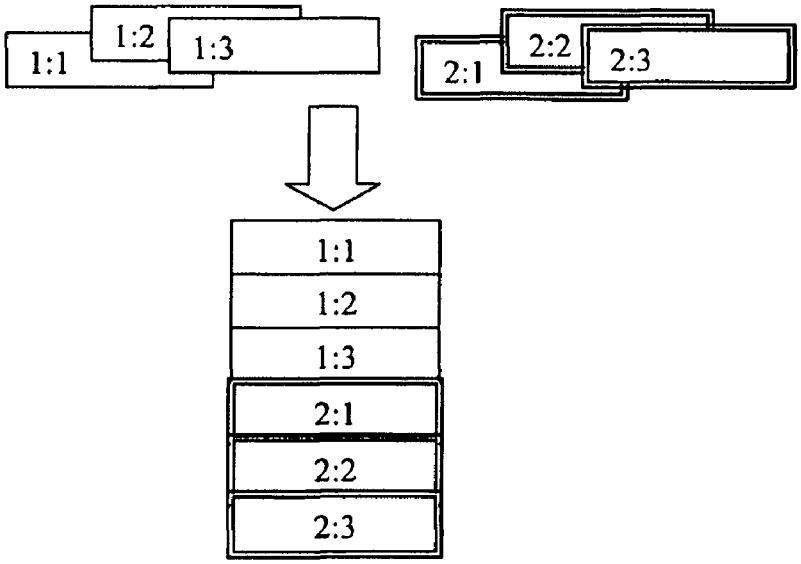

FIG. 8 shows two embroidery elements adjoining one another in an embroidery, the basic elements having the same colour within each embroidery element. The outcome of the colour sorting is shown at the bottom of the figure.

Figure 9:
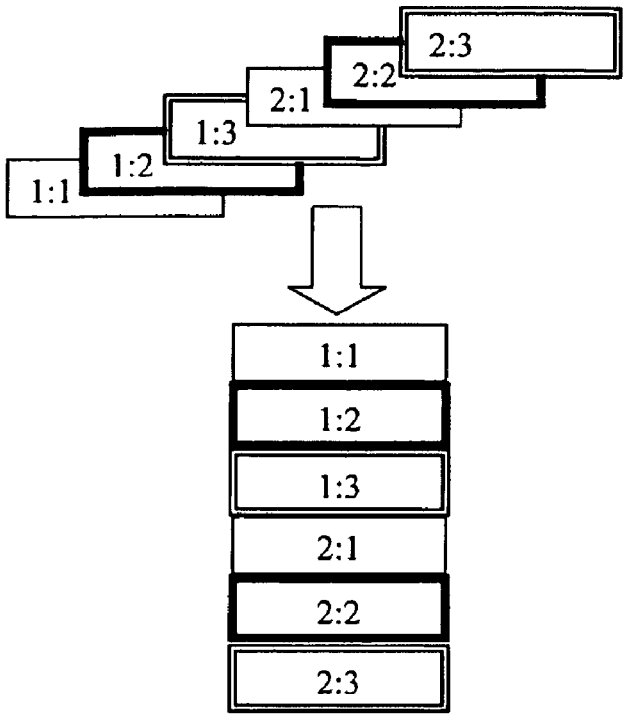

FIG. 9 shows two embroidery elements denoted by 1:1 to 1:3 and 2:1 to 2:3 respectively, the index figure indicating the designation for basic elements contained in each embroidery element. As can be seen from the figure and the outcome according to the algorithm, it is not possible to change the sewing order of the basic elements in this example, since all basic elements are superimposed on one another.

Figure 10:
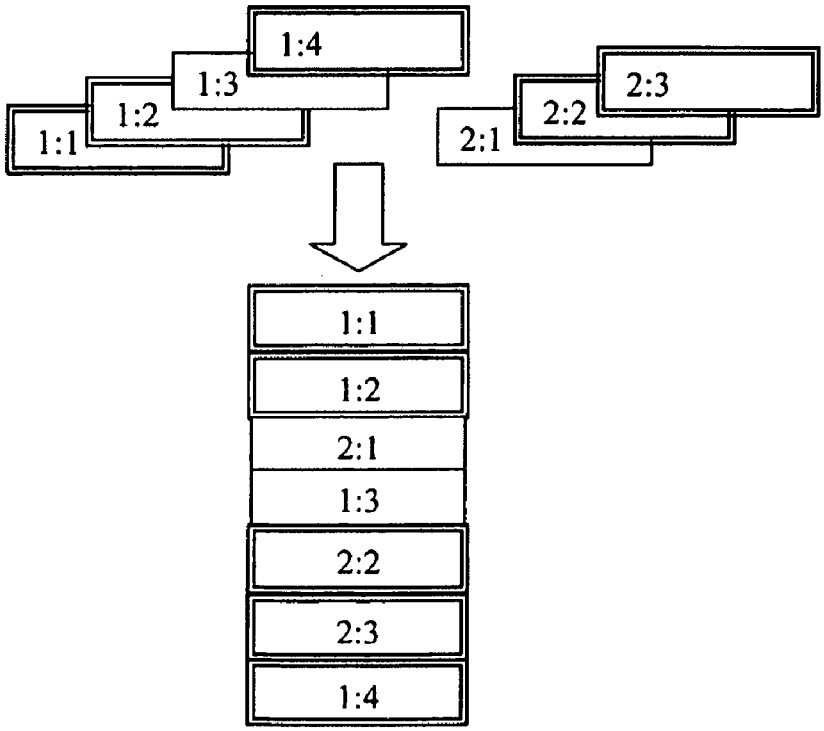

FIG. 10 shows chains which occur between basic elements in different layers in different embroidery elements. The basic elements in a first embroidery element are numbered from 1:1 to 1:4. The basic elements in a second embroidery element are numbered 2:1 to 2:3. The outcome of the algorithm gives a sewing order according to the listing of basic elements shown at the bottom of the figure.

Figure 11:
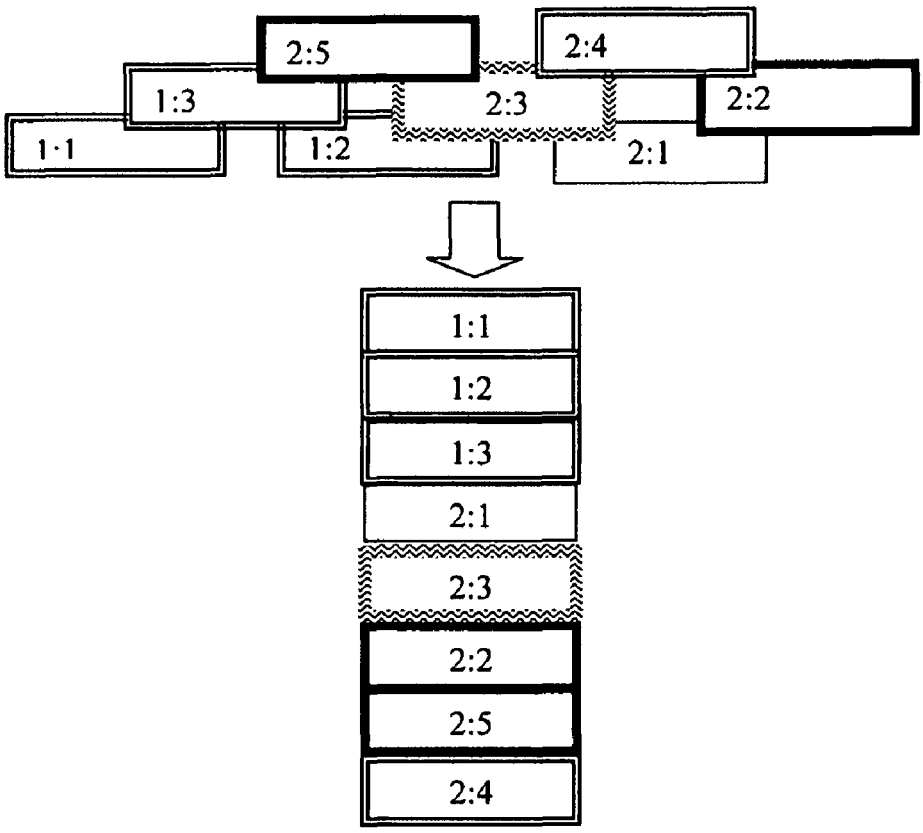

FIG. 11 shows a further example of chains between basic elements in different embroidery elements, the basic elements in a first embroidery element being numbered from 1:1 to 1:3 and the basic elements in a second embroidery element being numbered 2:1 to 2:5. Here again, the outcome of the algorithm for the sewing order is shown according to the list of basic elements at the bottom of the figure.

DEFINITIONS

A stitch consist of the sewing between two consecutively tied knots of upper thread and lower thread.

The term seam relates to a sequence of stitches.

An embroidery element here relates to the pattern for a specific sewing pattern repeatable by the sewing machine and comprising at least one basic element, which in turn comprises at least one stitch.

The term to execute a stitch is equivalent to the term to sew, or sewing.

An embroidery element forming part of an embroidery is made up of at least one and usually a plurality of basic elements.

A basic element consists of at least one stitch of any stitch type executed with a thread of a certain colour and/or with a thread of a certain quality, for example a silk thread.

A sub-area, in this case a sewing sub-area, is a sub-area which is accessible for a sewing machine without adjustments of the sewing machine, such as changing sides of a fabric stretched in an embroidery frame.

The invention claimed is:

1. A method for determining a sewing order in embroidering at least one embroidery element on a sewing material, the method comprising:

stretching the material on a stretching device mounted on an embroidery unit in a sewing machine utilizing a stretching device holder of the embroidery unit, wherein the stretching device comprises at least a first sub-area and a second sub-area, arranging the first sub-area and the second sub-area such that a position of the stretching device relative to the stretching device holder when embroidering in the first sub-area differs from a position of the of the stretching device relative to the stretching device holder when embroidering in the second sub-area, accessing with the embroidery unit a memory for stitch data for said embroidery element and a processor for reading said stitch data and for maneuvering the sewing machine to execute stitches according to stitch data, said at least one embroidery element comprising basic elements, said basic elements comprising characteristics including at least sub-area, color and thread type, forming clusters of basic elements such that the basic elements in the cluster are sewn on a same sub-area, wherein the clusters comprise an overriding priority based on an order in which the basic elements are added when composing the embroidery that is to be sewn on the sewing machine, determining a level for each cluster, sorting the clusters with regard to color and thread type, and sorting the formed and sorted clusters into a sewing order based on said characteristics.

2. The method according to claim 1, wherein determining the level for the clusters comprises an analytical scheme comprising determining whether an intersection exists of a current cluster with previously checked clusters, if an intersection exists between a current cluster and previously checked clusters add a two-way link between the current cluster and a previously checked cluster with which the current cluster intersects to indicate which of the currently cluster and the previously checked cluster is situated on top, and set the level of the current cluster above the previously checked cluster with which the current cluster intersects.

3. The method according to claim 2, wherein sorting of the clusters into a sewing order comprises:

sorting of the basic elements, wherein the sorting comprises running through all the characteristics of the basic elements, wherein running through the characteristics comprises determining on which levels each characteristic has associated clusters if a characteristic has associated clusters on a first level but not on a level above, placing the associated clusters into a list for sewing order and removing the associated clusters, and associations of the associated clusters from the analytical scheme, repeating running through all the characteristics determining on which levels each characteristic has an associated cluster, if the characteristics have an associated cluster on the first level, placing the associated cluster into the list for sewing order and removing the clusters, and associations of the clusters from the analytical scheme, running through all clusters on the level above, for all clusters that do not have any associations to any clusters below the level above and placing the clusters into the list for sewing order and remove the clusters, and associations of the clusters from the analytical structure.

4. A computer program product, comprising:

a non-transitory computer readable medium; and computer program instructions recorded on the computer readable medium and executable by a processor for carrying out a method for determining a sewing order in embroidering at least one embroidery element on a sewing material the method including stretching the material on a stretching device mounted on an embroidery unit in a sewing machine utilizing a stretching device holder of the embroidery unit, wherein the stretching device comprises at least a first sub-area and a second sub-area, arranging the first sub-area and the second sub-area such that a position of the stretching device relative to the stretching device holder when embroidering in the first sub-area differs from a position of the of the stretching device relative to the stretching device holder when embroidering in the second sub-area, accessing with the embroidery unit a memory for stitch data for said embroidery element and a processor for reading said stitch data and for maneuvering the sewing machine to execute stitches according to stitch data, said at least one embroidery element comprising basic elements, said basic elements comprising characteristics including at least sub-area, color and thread type, forming clusters of basic elements such that the basic elements in the cluster are sewn on a same sub-area, wherein the clusters comprise an overriding priority based on an order in which the basic elements are added when composing the embroidery that is to be sewn on the sewing machine, determining a level for each cluster, sorting the clusters with regard to color and thread type, and sorting the formed and sorted clusters into a sewing order based on said characteristics.

5. A sewing machine, comprising:

computer program instructions for carrying out a method for determining a sewing order in embroidering at least one embroidery element on a sewing material, the method including stretching the material on a stretching device mounted on an embroidery unit in a sewing machine utilizing a stretching device holder of the embroidery unit, wherein the stretching device comprises at least a first sub-area and a second sub-area, arranging the first sub-area and the second sub-area such that a position of the stretching device relative to the stretching device holder when embroidering in the first sub-area differs from a position of the of the stretching device relative to the stretching device holder when embroidering in the second sub-area, accessing with the embroidery unit a memory for stitch data for said embroidery element and a processor for reading said stitch data and for maneuvering the sewing machine to execute stitches according to stitch data, said at least one embroidery element comprising basic elements, said basic elements comprising characteristics including at least sub-area, color and thread type, forming clusters of basic elements such that the basic elements in the cluster are sewn on a same sub-area, wherein the clusters comprise an overriding priority based on an order in which the basic elements are added when composing the embroidery that is to be sewn on the sewing machine, determining a level for each cluster, sorting the clusters with regard to color and thread type, and sorting the formed and sorted clusters into a sewing order based on said characteristics; and a processor configured to decode the computer program instructions.

* * * * *